United States Patent [19]

De Feudis

[11] 3,948,167

[45] Apr. 6, 1976

[54] ARRANGEMENT AT CENTRAL SUCTION INSTALLATIONS FOR SUCTION CONVEYANCE OF REFUSE AND WASTE

[75] Inventor: Sergio De Feudis, Nacka, Sweden

[73] Assignee: Aktiebolaget Svenska Flaktfabriken, Nacka, Sweden

[22] Filed: Oct. 12, 1973

[21] Appl. No.: 405,923

[30] Foreign Application Priority Data

Oct. 17, 1972 Sweden ..... 13399

[52] U.S. Cl. ..... 100/215; 100/218; 100/249

[51] Int. Cl.[2] ..... B30B 15/30; B30B 15/32

[58] Field of Search ..... 100/229 A, 249, 215, 218, 100/250

[56] References Cited

UNITED STATES PATENTS

| | | | |
|---|---|---|---|
| 2,252,697 | 8/1941 | Brassart | 100/249 UX |
| 2,684,802 | 7/1954 | Rothwell | 100/229 A |
| 2,780,987 | 2/1957 | Wall | 100/249 UX |
| 3,089,410 | 5/1963 | Stangl | 100/249 UX |
| 3,513,771 | 5/1970 | Felts | 100/229 A |
| 3,583,770 | 6/1971 | Medhammar | 100/229 A |
| 3,621,774 | 11/1971 | Dedio et al. | 100/249 X R |

*Primary Examiner*—Billy J. Wilhite

*Attorney, Agent, or Firm*—Howson and Howson

[57] ABSTRACT

Apparatus for transferring waste from the collection chamber of a suction waste-collection system into a wastetransport container in which the collection chamber is at the minimum absolute pressure of the system and in which the transport container is at atmospheric pressure. The apparatus includes a compaction chamber having an inlet which is opened to the collection chamber and an outlet which is opened to the transport container. Airtight means is provided to close the outlet when the inlet is opened and other airtight means is provided to close the inlet when the outlet is opened. Waste material entering the compaction chamber through the inlet is compacted before being discharged through the outlet. The compaction device includes the outlet closure means as a back-up device and a pressure plate operable to compress the waste against the outlet closure. Preferably, the pressure plate is mounted on the forward face of a piston which operates concurrently with the inlet closure so that displacement of the piston is accompanied by closure of the inlet whereby upon full displacement of the piston to compact the trash in the chamber, the inlet is closed to pressure communication, whereupon the outlet may be opened to permit discharge of the compressed trash through the outlet into the transport container. Three embodiments are shown in the drawings.

6 Claims, 6 Drawing Figures

Figure 1A:
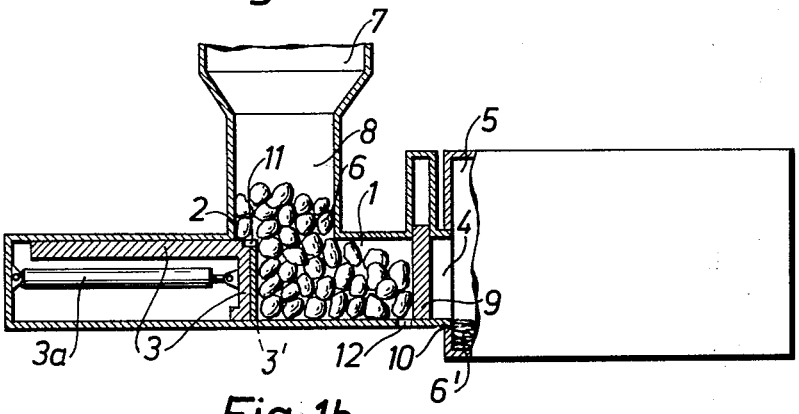
Figure 1B:
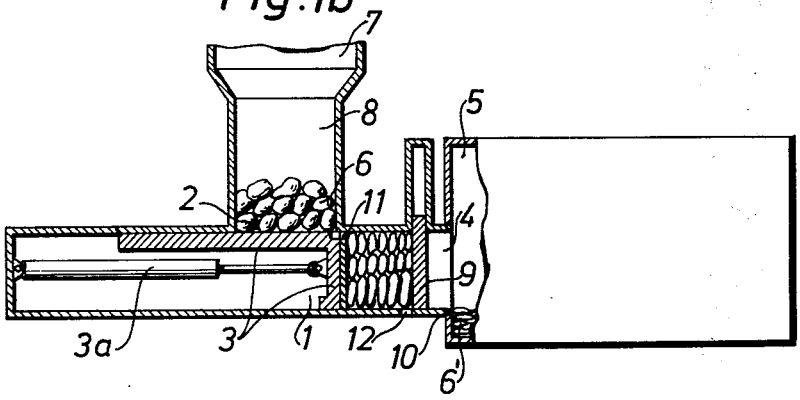
Figure 1C:
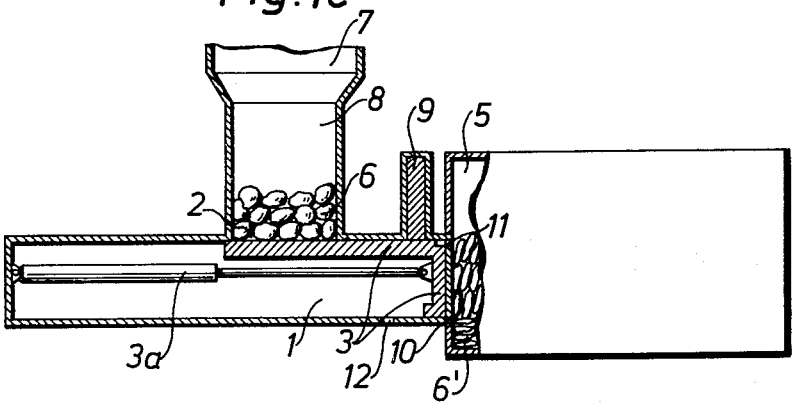

ARRANGEMENT AT CENTRAL SUCTION INSTALLATIONS FOR SUCTION CONVEYANCE OF REFUSE AND WASTE

This invention relates to an arrangement at central suction installations for refuse and waste, which are conveyed by being sucked with air at vacuum from a plurality of charging openings to a central collecting point, from which the refuse and waste are discharged at definite intervals and removed without disturbing the continuity of conveyance.

Modern planning of towns and densely populated areas as well as of concentrated hospital complexes, which are becoming increasingly usual, includes, as an equipment almost selfunderstood, pneumatic vacuum conveyance systems for the removal of refuse and waste. This is both for practical-economical reasons and in order to avoid the hygienic inconveniences involved with manual collection and handling of refuse and waste. One advantage of these automatic vacuum conveyance systems is their reliable operation during holidays when they are needed most, especially in view of the large consumption of throw-away packages for foodstuffs and other consumption articles in a modern community. In order to reduce the volume in each central collecting point, it was proposed to compress the refuse and waste, but this has implied in vacuum conveyance systems heretofore known the requirement of using pressure-resistant containers. Such containers are expensive to manufacture and heavy to handle in their transport to a refuse incinerator plant. The present invention has its object to solve the problem by applying compression and at the same time using conventional cheap transport containers, in order thereby to reduce the initial and the operation costs of the automatic vacuum conveyance installations and in this way to render them more profitable. This would result in a wider use of pneumatic vacuum conveyance systems which is desirable both from an environmental and comfort point of view.

The solution of the aforesaid problem is characterized according to the present invention, in that the refuse and waste on their passage out to a closed transport container are caused to fall into and pass through a sluice means, which has an inlet port and an outlet port and in which the air pressure can be changed from its value in the conveying system to atmospheric pressure whereby special pressure-resistant containers with strength particularly against inner vacuum are unnecessary, that the sluice means is designed so as be made subject to a reduction in volume when the refuse and waste are passing therethrough to be compressed prior to their transfer to said transport container, and in which the air pressure can be brought to the same value as in the sluice means. An expedient embodiment of such an arrangement is characterized in that the inlet port of the sluice means is designed as a piston, which reciprocates in the sluice means and is adapted to dropping of the refuse and waste through the inlet port of the sluice means from a collecting container, which is located thereabove and attached to the end of the central suction installation after its coarse and fine separators, and that the piston during its motion is caused to compress the refuse and waste by pressing it together against a locking device located at the outlet from the sluice means.

An advantageous embodiment of the arrangement is characterized in that the piston is adapted, subsequent to the opening of the outlet port of the sluice means, to convey the compressed refuse and waste out of the sluice means. Said piston, according to another embodiment, is characterized in that it is designed so as subsequent to the openings of the outlet port to convey the refuse and waste directly into the detachably attached transport container. A further embodiment is characterized in that the aforesaid compressing and conveying piston is adapted to act simultaneously as a locking device at the inlet end of the sluice means. A further suitable embodiment is characterized in that it includes between the collecting container and the sluice means, above the inlet port of the sluice means, a portioning chamber defined by gates and a bottom cover, which latter is designed to act as an air-tight locking device at the inlet of the sluice means between the central suction installation and the sluice means.

The invention is described in greater detail in the following, with reference to the accompanying drawings, in which FIGS. 1*a,b,c* show by way of section different operation positions of a sluice means with the inlet directly below a collecting container for refuse and waste and an outlet closed by a locking device adapted to be moved aside at the outlet.

Figure 2A:
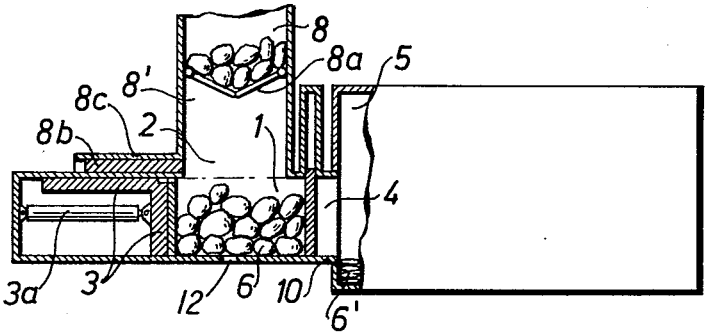
Figure 2B:
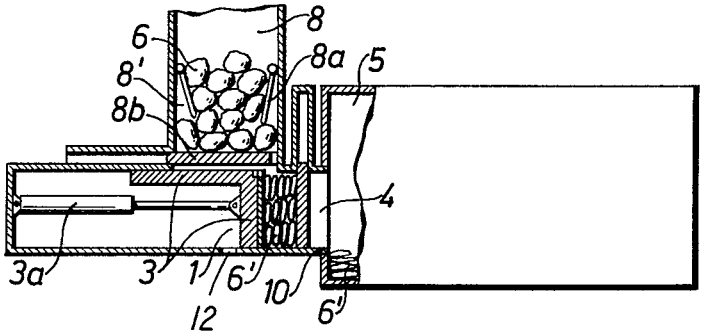
Figure 2C:
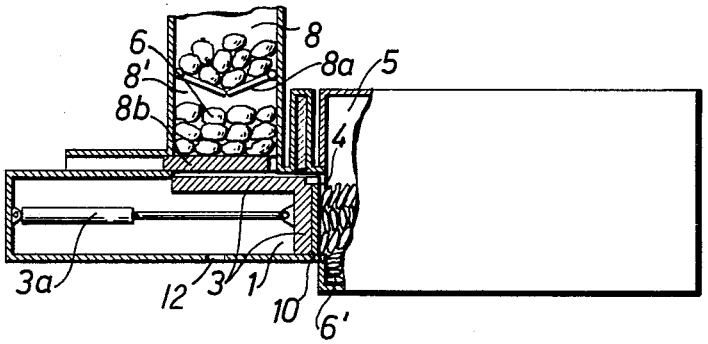

FIGS. 2*a,b,c* show by way of section different operation positions of a corresponding sluice means completed by a portioning chamber between the collecting container and sluice means.

In the Figures, 1 designates a sluice means with an inlet port 2 and an outlet port 4, at which a blocking device 9 is situated. 3 designates a piston reciprocable in the sluice means and acting as a compressing and conveying piston. Said piston according to the construction shown in FIGS. 1*a,b,c* is adapted to act simultaneously as a blocking device at the inlet end of the sluice means. 7 designates in a schematic way a part of the central suction installation, and 8 designates a collecting container located above the inlet port of the sluice means and mounted after the coarse and fine separators included in the central suction installation. 10 designates a means for retaining the container 5 against the outlet port of the sluice means 1. 11 and 12 designate apertures in the casing of the sluice means for balancing the air pressure between the sluice means and said collecting container, in which the same vacuum prevails as in the central suction installation 7, and, respectively, for supplying atmospheric air into the sluice means, before the blocking device is caused to expose the opening of the transport container for transferring by the piston 3 the volume of compressed refuse and waste, which is to be transferred and accumulated in the transport container. The refuse and waste falling down from the collecting container is designated by 6, and in compressed state it is designated by 6'. The movable piston 3 is actuated by a pneumatic or hydraulic means 3*a*. The rearward position of the piston, in which the inlet port is entirely exposed, is designated by 3'. In its forward position the piston 3 presses the refuse and waste against the surface of the blocking device 9 which is formed as a strong press surface. The transport container, as already mentioned, is of a conventional type, i.e., not of a special pressure-resistant construction, for example of standard type, i.e. without any special sealing means.

In the embodiment shown in FIGS. 2*a,b,c*, 8' designates a portioning chamber located below the collecting container, and 8*b* designates, for example, a pneumatically actuated bottom cover. 8*a* are two so called gates.

At the modified embodiment shown in FIGS. 3*a,b,c*, 14 designates an intermediate chamber located between the sluice means 1 and transport container 5, and 13 designates a second movable piston, one side of which replaces the previously shown locking device 9. This modified embodiment renders it possible to clean in a simple way the forward surface of the piston 3 by scraping.

I claim:

1. An apparatus for the conveyance and collection of waste material by means of suction having a collection chamber at sub-atmospheric pressure for the material conveyed and collected in the system, the improvement comprising means to receive the material from the collection chamber, compact the material and discharge the compacted material into a transport container without substantial exposure of the interior of said transport container to the sub-atmospheric pressure in said collection chamber, and comprising in combination a compaction chamber having an inlet connected to said collection chamber and an outlet opening into said transport container, said inlet having sealing means operable controllably to close or open the inlet against communication of air from said compaction chamber to said collection chamber and said outlet having sealing means operable controllably to prevent or permit communication of air from the transport container to said compaction chamber, said compaction chamber including compaction means operable to compress the material in said compaction chamber to a reduced volume, said inlet sealing means being operable to close said inlet against air flow upon compaction of the material whereby said outlet sealing means may be opened without substantial flow of air through said outlet sealing means into said collecting chamber, said compaction means comprising means to discharge the material from said compaction chamber through said outlet after opening of said outlet sealing means.

2. Apparatus according to claim 1 wherein said compaction chamber comprises an elongated tubular wall and said means to compact the material in said compaction chamber comprises a piston slidable along said compaction chamber wall, said inlet to said compaction chamber being in the wall of said compaction chamber in the path of said piston whereby displacement of said piston past said inlet operates to close communication from said compaction chamber to said collection chamber through said inlet.

3. Apparatus according to claim 2 wherein said piston has a pressure plate on its leading face and a skirt trailing said pressure plate whereby said skirt operates to close said inlet in the wall of said compaction chamber.

4. Apparatus according to claim 2 wherein said outlet sealing means constitutes an endwall for said compaction chamber remote from said piston whereby the displacement of said piston past said inlet operates to compact the trash between said endwall and said piston.

5. Apparatus according claim 1 wherein said inlet includes gate means in advance of said inlet closure means to meter a charge of material for said compaction chamber, said charge being collected in said inlet intermediate said gate means and said inlet sealing means, said means being operated to charge said charge into said compaction chamber to thereby afford discharge of a predetermined volume of material from said collecting chamber for each operation of said compaction means.

6. Apparatus according to claim 1 including bleeder vent means in said compaction chamber to afford equalization to atmospheric pressure of sub-atmospheric pressure in said compaction chamber when both of said inlet sealing means and said outlet sealing means are closed.

* * * * *